US007198350B2

(12) United States Patent
Nakashima

(10) Patent No.: US 7,198,350 B2
(45) Date of Patent: Apr. 3, 2007

(54) IMAGE FORMATION APPARATUS AND RECOVERY EJECTION METHOD OF PRINT HEAD

(75) Inventor: Atsuhisa Nakashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 257 days.

(21) Appl. No.: 10/809,463

(22) Filed: Mar. 26, 2004

(65) Prior Publication Data

US 2004/0189737 A1 Sep. 30, 2004

(30) Foreign Application Priority Data

Mar. 27, 2003 (JP) ..... 2003-088721

(51) Int. Cl.
*B41J 2/165* (2006.01)

(52) U.S. Cl. ..... 347/23; 347/29; 347/30; 347/32; 347/33

(58) Field of Classification Search ..... 347/19, 347/22–35

See application file for complete search history.

(56) References Cited

U.S. PATENT DOCUMENTS 5,572,242 A * 11/1996 Fujii et al. ..... 347/23
5,805,182 A 9/1998 Lee
6,672,705 B2 * 1/2004 Kitahara et al. ..... 347/42
2002/0018097 A1 2/2002 Kitahara et al.

FOREIGN PATENT DOCUMENTS

| | | |
|---|---|---|
| EP | 0 525 988 A2 | 2/1993 |
| EP | 0 525 988 A2 | 2/1998 |
| EP | 1 287 996 A1 | 3/2003 |
| JP | A 4-097853 | 3/1992 |
| JP | A 6-15815 | 1/1994 |
| JP | A 11-192723 | 7/1999 |
| JP | A 2001-063088 | 3/2001 |
| JP | A 2002-103598 | 4/2002 |
| JP | A 2003-127429 | 5/2003 |

* cited by examiner

*Primary Examiner*—Shih-Wen Hsieh
(74) *Attorney, Agent, or Firm*—Oliff & Berridge, PLC

(57) ABSTRACT

An image formation apparatus includes: a transport unit that transports a record medium; a print head having a plurality of nozzles that ejects ink, thereby forming an image on the record medium; a first recovery ejection unit that performs recovery ejection of nozzles used for forming an image on the record medium; and a second recovery ejection unit that performs recovery ejection of at least one of the plurality of nozzles in accordance with a time elapsed from a previous recovery ejection.

19 Claims, 9 Drawing Sheets

IMAGE FORMATION APPARATUS AND RECOVERY EJECTION METHOD OF PRINT HEAD

BACKGROUND OF THE INVENTION

1. Field of the Invention

The present invention relates to an image formation apparatus and in particular to an image formation apparatus for making it possible to control the timing of recovery ejection of a nozzle of a print head for executing image formation. The invention also relates to a recovery ejection method of a print head in an image formation apparatus.

2. Background Art

Hitherto, an image formation apparatus for recording an image, etc., on a record medium such as paper while transporting the record medium has been widely used. An ink jet printer widely used among the image formation apparatus forms ink droplets by pressure of piezoelectric elements or thermal foam and ejecting the ink droplets directly onto a record medium from a nozzle of a print head.

Ink in the vicinity of each ink nozzle of a print head increases in viscosity as the volatile component of water content, etc., evaporates and dries over time. In an ink jet printer of an on-demand system for determining whether or not ink is ejected based on record data, the following problem easily occurs particularly in ink nozzles through which ink is ejected less frequently: Ink increases in viscosity and ejection of ink from the print head becomes unstable or it is made impossible to eject ink.

Thus, ejection called flushing or recovery ejection is conducted for expelling ink increased in viscosity from the nozzle aside from ink ejection for forming an image on a record medium.

JP-A-6-15815 discloses an art for flushing on print paper of a record medium. In an ink jet record apparatus disclosed in JP-A-6-15815, when power is turned on, a record head is moved from a standby position to a position facing print paper and ink is ejected from all nozzles, thereby performing flushing.

JP-A-6-15815 also gives a description indicating that a predetermined flushing pattern may be printed instead of ejecting ink from all nozzles.

SUMMARY OF THE INVENTION

However, if ink is ejected from all nozzles whenever flushing is conducted, ink is also ejected from nozzles where an increase in viscosity of ink does not occur, increasing the ink consumption amount; this is a problem.

If a predetermined pattern is printed for flushing instead of ejecting ink from all nozzles, ink dries in the nozzles through which no ink is ejected, and it is made impossible to eject ink and then purge operation must be performed; this is a problem. The purge operation is operation of forcibly sucking ink from the inside of the nozzle by a suction pump or in contrast, pressurizing the inside of the nozzle by a suction pump for discharging ink. Since the purge operation takes time to some extent, the user must wait until it is made possible to form an image.

Further, if the size of used print paper, particularly the paper width is smaller than the nozzle width of the print head, the transport mechanism in the portion jutting out of the paper is contaminated with flushing ink.

An image formation apparatus is disclosed herein, which makes it possible to perform recovery ejection of nozzles of a print head without wasting ink and which also makes it possible to skip purging.

An image formation apparatus is also disclosed herein, which suppresses contamination of a transport mechanism with ink resulting from recovery ejection.

A recovery ejection method of a print head in the image formation apparatus is disclosed herein, which is improved as mentioned above.

According to one aspect of the invention, an image formation apparatus includes: a transport unit that transports a record medium; a print head having a plurality of nozzles that eject ink, thereby forming an image on the record medium; a first recovery ejection unit that performs recovery ejection of nozzles used for forming an image on the record medium; and a second recovery ejection unit that performs recovery ejection of at least one of the plurality of nozzles in accordance with a time elapsed from a previous recovery ejection.

According to the configuration, the nozzles are separated into the nozzles used for image formation and those not used for image formation for performing recovery ejection separately, so that wasting of ink can be lessened and the use time period of ink can be prolonged. The first recovery ejection unit performs recovery ejection of nozzles used for image formation, whereby the nozzles used for image formation are always kept good, so that the good quality of the formed image is ensured. Since the first recovery ejection unit ejects ink at the non-image-formation position, ink resulting from the recovery ejection is not deposited on the formed image. Further, since the second recovery ejection unit may perform recovery ejection of nozzles not used for image formation, drying of the nozzles not used for image formation is prevented and the print head is always maintained in an available state; purging can be skipped.

The invention may provide a recovery ejection method in an image formation apparatus including a transport unit for transporting a record medium and a print head having a plurality of nozzles for ejecting ink for forming an image. The method may include: performing a first recovery ejection of nozzles used for forming an image on the record medium; and performing a second recovery ejection of at least one of the plurality of nozzles in accordance with a time elapsed from a previous recovery ejection.

The invention may provide an image formation apparatus includes: a transport belt that transports a record medium in a transporting direction and includes a surface having a recess extending in a predetermined direction that crosses the transporting direction; a print head having a plurality of nozzles that ejects ink on the record medium: a maintenance unit movable between a first position and a second position, the maintenance unit positioned at the first position while the nozzle is not ejecting the ink and at the second position while the nozzle is ejecting the ink, the first position being between the print head and the transport belt, the second position positioning in the predetermined direction with respect to the first position; and a controller configured to control driving of the transport belt and the print head and to perform a recovery ejection operation of the nozzles of the print head; wherein the controller controls the transport belt and the print head so that the ink is ejected onto the recess while performing the recovery ejection operation; and the maintenance unit includes a cleaning portion that cleans the recess when the maintenance unit moves between the first position and the second position.

BRIEF DESCRIPTION OF THE DRAWINGS

The present invention may be more readily described with reference to the accompanying drawings.

DETAILED DESCRIPTION OF THE PREFERRED EMBODIMENTS

Referring now to the accompanying drawings, there is shown a preferred embodiment of the invention.

Figure 1:
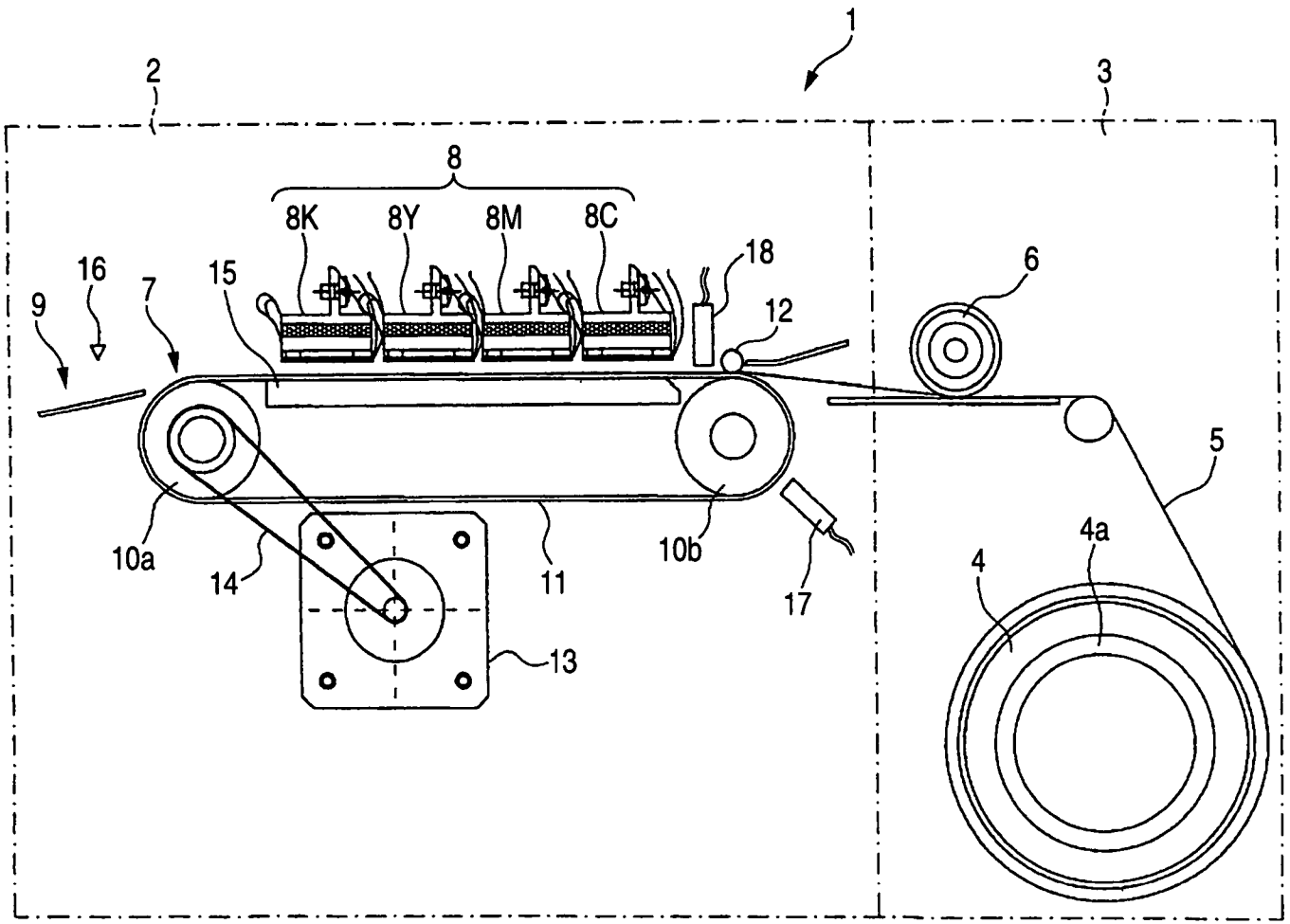
FIG. 1 is a drawing to show a schematic configuration of an ink jet printer of an embodiment of the invention.

As shown in FIG. 1, an ink jet printer 1 as one embodiment of an image formation apparatus is made up of a printer main unit 2 and a paper feed section 3. The paper feed section 3 is provided with roll paper 4 and a feed roller 6 for delivering paper 5 drawn out from the roll paper 4 to the printer main unit 2. The feed roller 6 is rotated by a feed motor 62 (see FIG. 4). The roll paper 4 has the paper 5 long as a record medium wound around a cylindrical paper tube and is supported on a support shaft for rotation. To supply flat paper 5 to the printer main unit 2, the paper feed section 3 maybe provided with a mechanism for removing curl from the roll paper 4. In doing so, the image quality when an image is formed in the printer main unit 2 (described later) can be improved.

The printer main unit 2 includes a transport mechanism 7 for transporting the paper 5 supplied from the paper feed section 3, an ink jet printer head section 8, an ejection section 9 to which the paper 5 with an image formed thereon is ejected, and a maintenance section 20 (see FIG. 9) for maintaining the transport mechanism 7 and the print head section 8.

Figure 2:
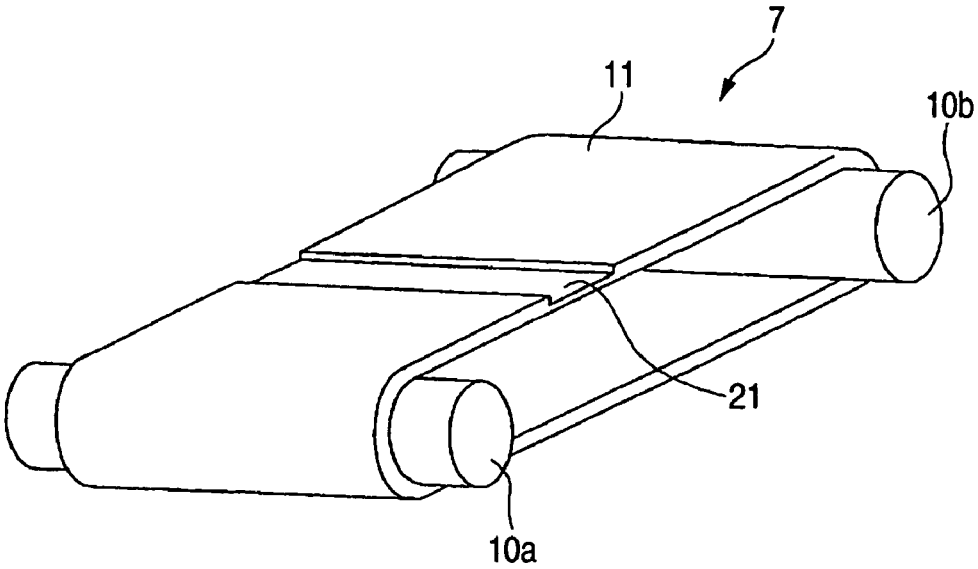
FIG. 2 is a drawing to show a schematic configuration of a transport belt.
Figure 3:
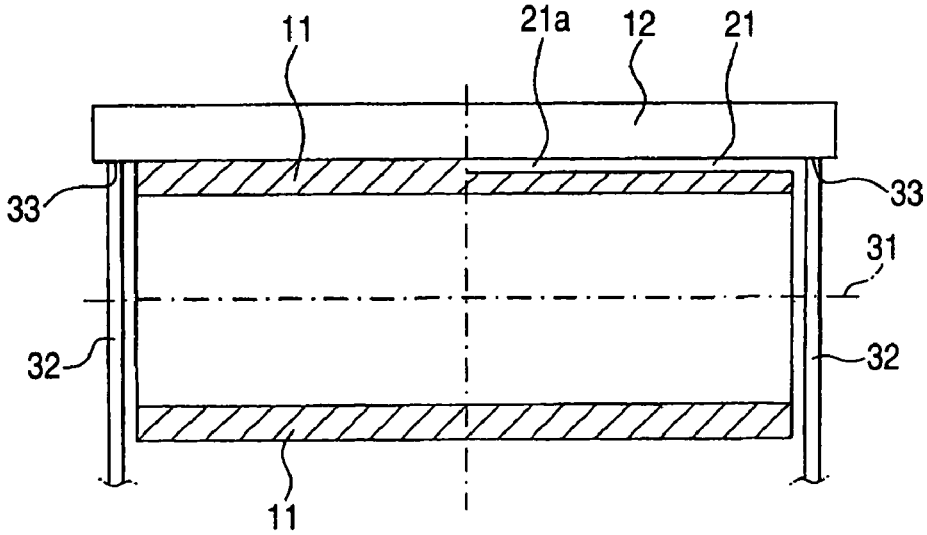
FIG. 3 is an enlarged view of a nip roller and its vicinity.

The transport mechanism 7 has two transport rollers 10*a* and 10*b* placed with a predetermined spacing, a transport belt 11 as transport means placed on the transport rollers 10*a* and 10*b*, a nip roller 12 placed facing the transport roller 10*b* of a driven roller, and a transport motor 13 for driving the transport roller 10*a* of a drive roller. The transport belt 11 has a flushing area 21 formed like a groove on the outer face of the belt, as shown in FIG. 2. The flushing area 21 (described later in detail) is used as an area where flushing is performed. The nip roller 12 is provided for pressing the paper 5 against the transport belt 11. The transport belt 11 is formed on a surface with an adhesive layer and the paper 5 is pressed against the transport belt 11 by the nip roller 12, whereby the paper 5 sticks to the adhesive layer and is transported under the print head section 8 in this state. To prevent the nip roller 12 from dropping into a groove 21*a* in the flushing area 21 when the groove 21*a* comes to the position of the nip roller 12, frames 32 for supporting rotation shafts 31 of the transport rollers 10*a* and 10*b* are provided with abutment parts 33 for abutting the nip roller 12, as shown in FIG. 3. When the flushing area 21 does not come to the position facing the nip roller 12 (see the left half of FIG. 3), the abutment part 33 gives a press force for fixing paper to the transport belt 11 with the paper (not shown) sandwiched between the transport belt 11 and the nip roller 12. When the flushing area 21 comes to the position facing the nip roller 12 (see the right half of FIG. 3), the abutment part 33 abuts the nip roller 12 so as to prevent the nip roller 12 from dropping into the groove 21*a*. The rotation drive force of the transport motor 13 is transmitted to the transport roller 10*a* by a belt 14 placed on the drive shaft of the transport motor 13 and the transport roller 10*a*.

The print head section 8 includes a black ink head 8K for ejecting black ink, a yellow ink head 8Y for ejecting yellow ink, a magenta ink head 8M for ejecting magenta ink, and a cyan ink head 8C for ejecting cyan ink for executing full color print. Each of the print heads 8K, 8Y, 8M, and 8C includes drive elements such as piezoelectric elements used to eject ink droplets from nozzles and is of a full-line type wherein a large number of ink nozzles are arranged throughout the area in the belt width direction orthogonal to the transport direction of the transport belt 11. The ink heads 8K, 8Y, 8M, and 8C are arranged in parallel with each other along the transport direction of the transport belt 11.

A belt guide 15 for guiding the transport belt 11 is provided below the print head section 8, and a cutter 16 for cutting the paper 5 is provided in the ejection section 9.

A flushing area detection sensor 17 for detecting the flushing area 21 formed as a recess on the transport belt 11 and a paper detection sensor 18 for detecting the paper 5 are provided in the vicinity of the transport roller 10*b* of the driven roller. Sensors such as a reflection photosensor and a photointerrupter can be used as the flushing area detection sensor 17 and the paper detection sensor 18.

Figure 9:
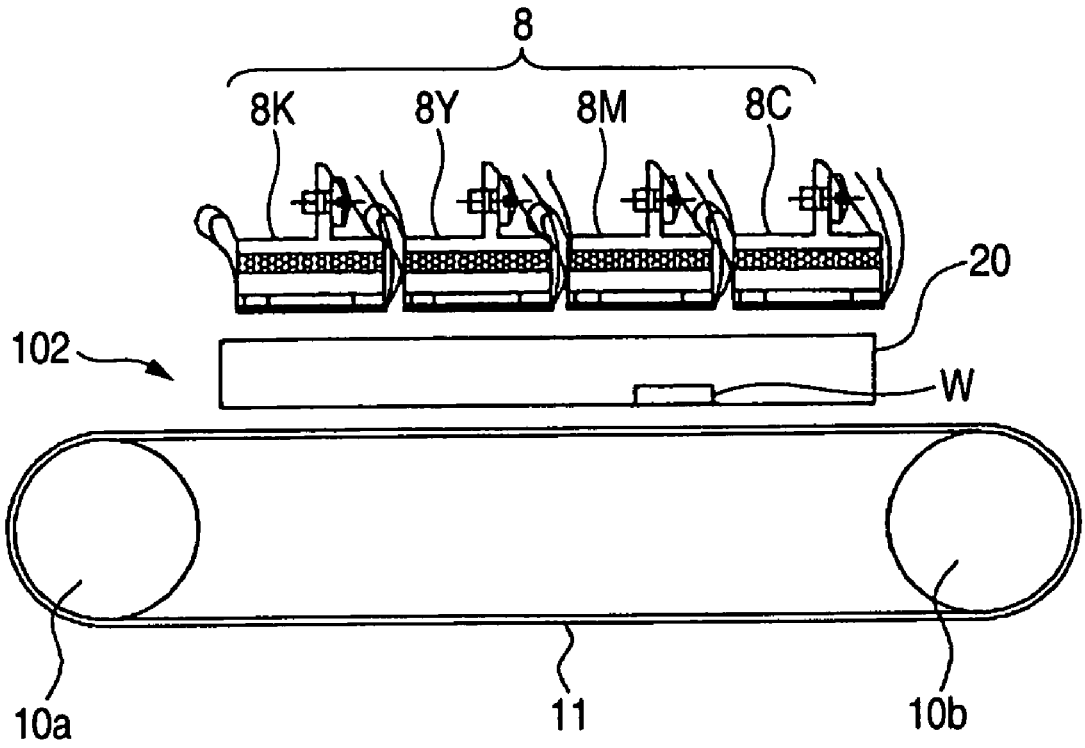
FIG. 9 is a schematic drawing to show the operation state of a maintenance section.

The maintenance section 20, whose operation state is schematically shown in FIG. 9, includes a capping mechanism for covering the print head section 8 with a dry prevention cap when print is not performed and a cleaning mechanism for cleaning the flushing area 21 of the transport belt 11 in conformance with the capping operation of the capping mechanism. The capping mechanism is made up of, for example, a mechanism section for moving up the print head section 8 by a predetermined distance for bringing the print head section 8 away from the transport belt 11, a mechanism section for inserting a plate-like cap having a size covering the print head section 8 into the gap between the print head section 8 and the transport belt 11, and a mechanism section for pressing the cap against the print head section 8. For example, a felt-like wiper W for wiping the recess of the flushing area 21 is used as the cleaning mechanism.

Figure 10:
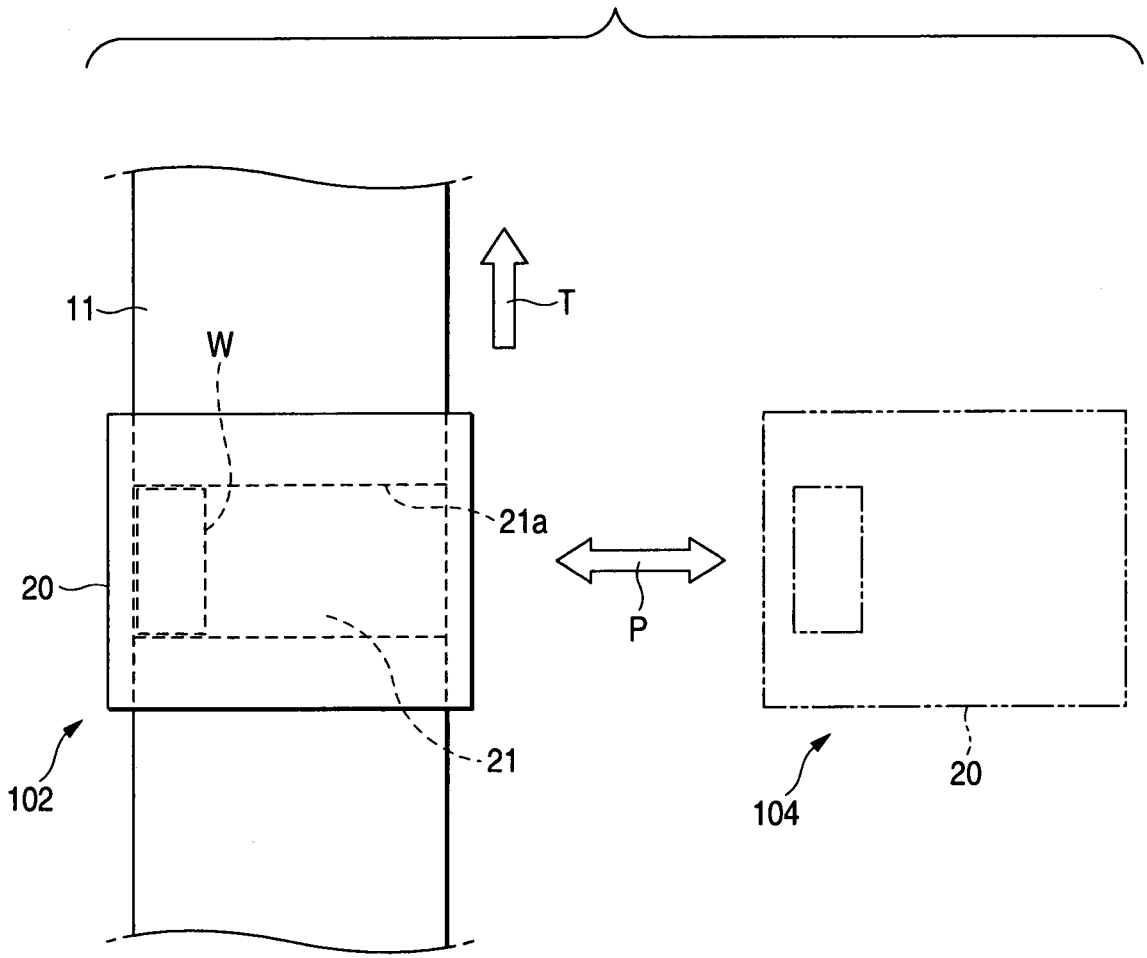
FIG. 10 is a schematic planar view showing a positional relationship between the transport belt and a movable maintenance unit.

As shown in FIG. 10, the maintenance unit 20 is movable between a first position 102 and a second position 104. The first position 102 is between the print head 8 and the transport belt 11, as shown in FIG. 9. The maintenance unit 102 is positioned at the first position 102 when the print is not performed (while the nozzle is not ejecting the ink). At the first position 102, the maintenance unit 20 is disposed so as to face the transport belt 11 and drives the capping mechanism to cover the print head 8. As shown in FIG. 10, the second position 104 is positioned with respect to the first position 102 in a predetermined direction P that is substantially perpendicular to a transport direction T in which the transport belt 11 transports paper to be printed. The maintenance unit 20 is positioned at the second position 103 when the print is performed (while the nozzle is ejecting the ink). The predetermined direction P corresponds to the direction in which the groove 21*a* extends.

The wiper W may be disposed in the groove 21*a* when the maintenance unit 20 is positioned at the first position 102 and the transport belt 11 is driven so that the groove 21*a* faces to the wiper W. In this case, the wiper W may move within the groove 21*a* in the predetermined direction P and wipe the groove 21*a* while the maintenance unit 20 moves between the first position 102 and the second position 104.

Figure 4:
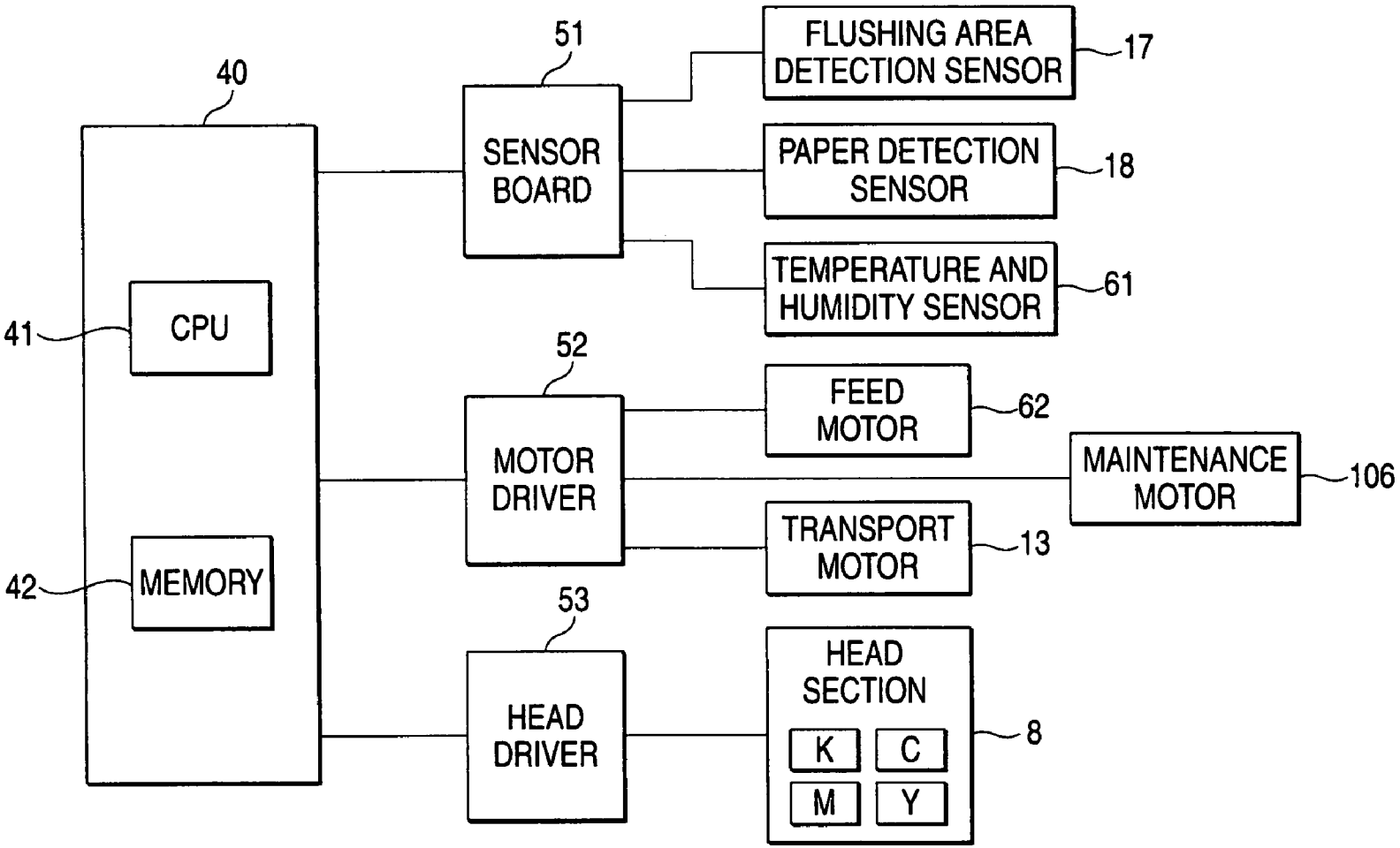
FIG. 4 is a block diagram to show the electric configuration of the ink jet printer of the embodiment of the invention.

FIG. 4 is a block diagram to show the configuration of a control section of the ink jet printer 1. The control section 40 includes a CPU 41 and memory 42 for storing an operation program of the CPU 41 and various pieces of data. Recovery ejection timing data indicating the timing at which nozzle recovery ejection of the print head section 8 is performed is stored in the memory 42. The control section 40 is connected through a sensor board 51 to the flushing area detection sensor 17 and the paper detection sensor 18 and also to a temperature and humidity sensor 161 for detecting the temperature and humidity in the environment in which the ink jet printer 1 is installed. The reason why the temperature and humidity are detected is that the ink drying speed varies depending on the temperature and humidity and therefore the flushing timing needs to be changed depending on the temperature and humidity. Therefore, data represented like a map with the temperature and humidity as parameters is used as the recovery ejection timing data. The data is previously found by experiment. For example, a device using a platinum resistor and an electrical capacitance sensor in combination can be used as the temperature and humidity sensor 61

The control section 40 is also connected through a motor driver 52 to the feed motor 62, the transport motor 13 and a maintenance motor 106 for driving the movement of the maintenance unit 20 between the first position 102 and the second position 104.

Further, the control section 40 is connected through a head driver 53 to the print heads 8K, 8C, 8M, and 8Y.

The control section 40 may control the transport belt 11 and drive the maintenance motor 106 to move the maintenance unit 20 from the second position 104 to the first position 102 each time recovery ejection of the print heads 8K, 8C, 8M, and 8Y (later described) is terminated, so that the groove 21*a* is wiped with the wiper W.

Figure 5:
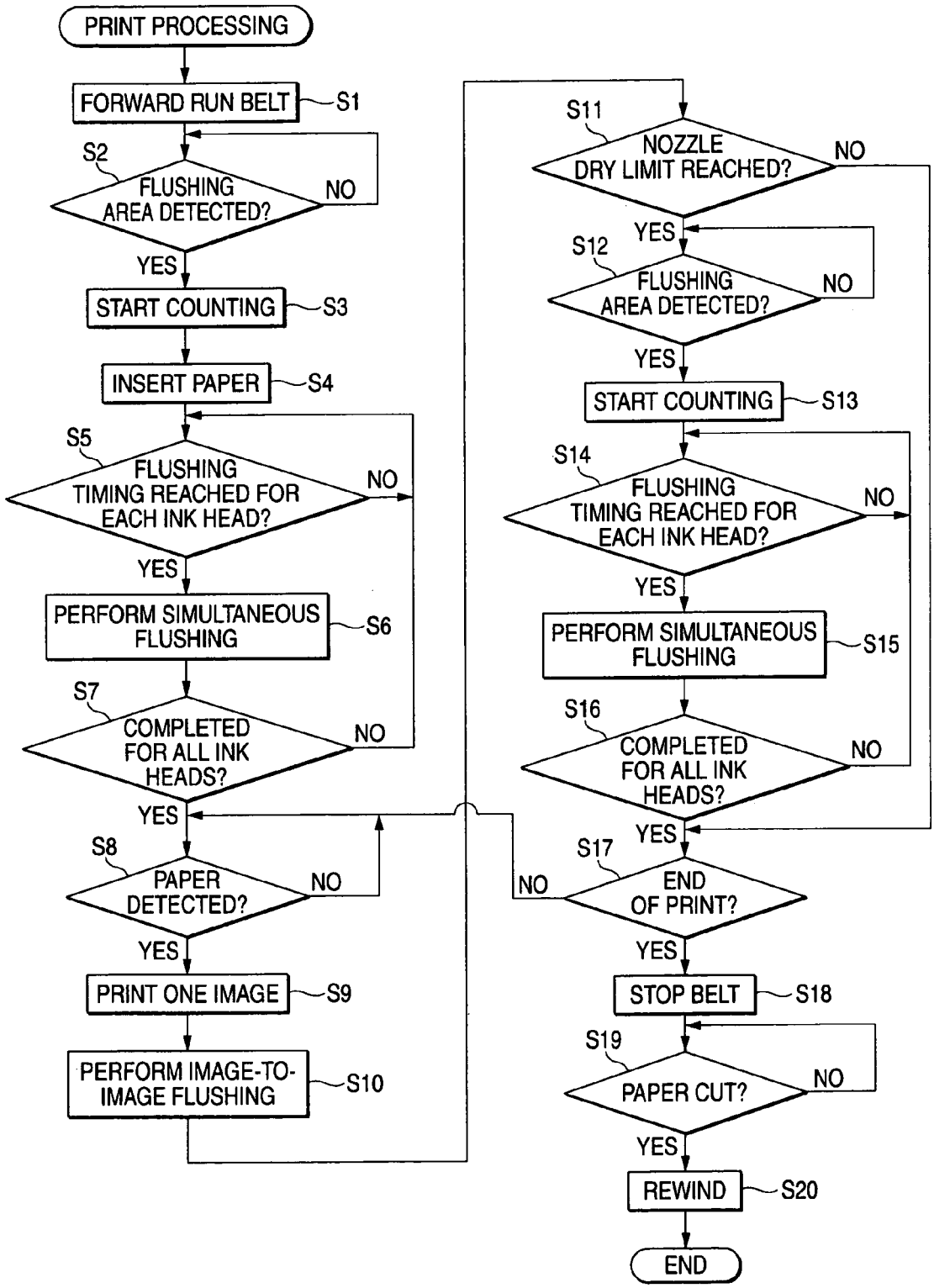
FIG. 5 is a flowchart to describe the operation of the ink jet printer of the embodiment of the invention.

FIG. 5 is a flowchart to describe the operation of the ink jet printer 1 of the embodiment. Next, the operation of the ink jet printer 1 will be discussed based on FIG. 5.

The operation shown in FIG. 5 is started as the CPU 41 receives a print signal. To begin with, at step S1, the CPU 41 rotates the transport motor 13 for forward running the transport belt 11. Forward running of the transport belt 11 continues until it is stopped at step S18 described later.

At step S2, the CPU 41 waits until the flushing area detection sensor 17 detects the flushing area 21. When a flushing area detection signal indicating that the flushing area 21 is detected is output from the flushing area detection sensor 17, at step 53, the CPU 41 causes a counter to start counting for the timings of flushing and paper insertion. The counter is incremented every drive pulse of the transport motor 13. Thus, the value of the timing counter indicates the position of the flushing area 21 changing each time the transport motor 13 is driven one pulse.

Next, at step S4, the CPU 41 drives the feed motor 62 for inserting the paper 5 into the transport mechanism 7. Preferably, when the flushing area 21 passes through the position of the nip roller 12, the paper 5 is inserted. To do this, when the value of the timing counter becomes predetermined paper insertion timing, the paper 5 may be inserted.

Figure 6:
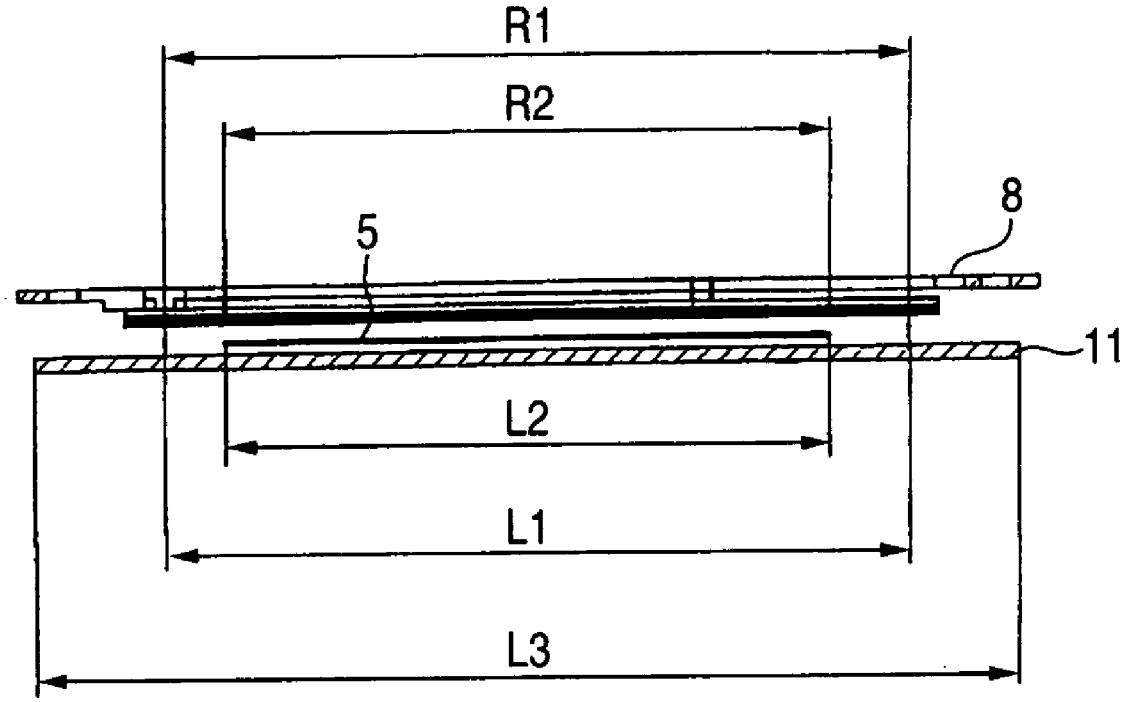
FIG. 6 is a drawing to describe the relationship between the size of an image formation area and the size of print paper.

Next, at step 55, the CPU 41 determines whether or not the value of the counter is a predetermined flushing timing value for each ink head. If the flushing timing is reached for any of the ink heads, at step S6, the CPU 41 performs simultaneous flushing for ejecting ink from all nozzles of the ink head. Specifically, the flushing area 21 on the transport belt 11 passes through below the print head section 8 in the order of the cyan ink head 8C, the magenta ink head 8M, the yellow ink head 8Y, and the black ink head 8K and thus when the flushing area 21 comes just below the ink head, flushing is performed for all nozzles of the ink head. A simultaneous flushing area R1 matches an image formable area L1 of the print head section 8, as shown in FIG. 6.

Next, at step S7, the CPU 41 determines whether or not simultaneous flushing is complete for all ink heads requiring simultaneous flushing. If not complete, the CPU 41 returns to step S5. On the other hand, if the CPU 41 determines at step S7 that simultaneous flushing is complete for all ink heads requiring simultaneous flushing, at step S8, the CPU 41 waits until the paper detection sensor 18 detects the paper 5. The simultaneous flushing may be performed regardless of the presence or absence of the paper 5; if the simultaneous flushing is performed when the paper 5 exists, the simultaneous flushing may be performed after the paper 5 is detected. In this case, step S8 (paper detection determination step) may be executed preceding step S5.

If the paper 5 is detected at step S8, at step S9, the CPU 41 prints an image by the print heads 8K, 8Y, 8M, and 8C. Here, printing an image means printing a continuous image without any break. If it is possible to print without degradation of the image quality without image-to-image flushing (described later), two or more images may be printed continuously.

Figure 7A:
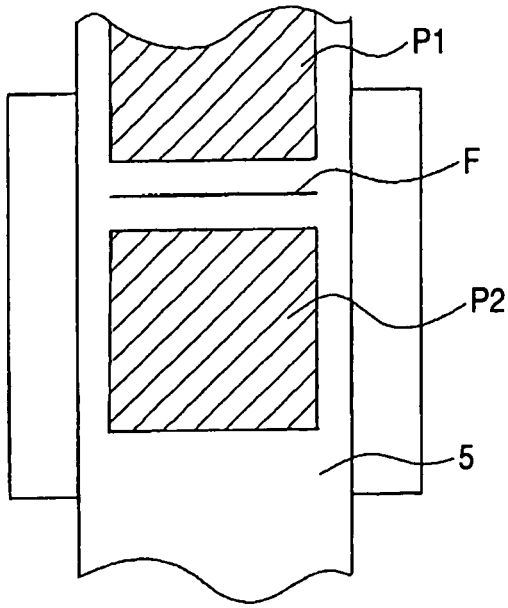
FIGS. 7A and 7B are drawings to describe the positional relationship between images and a flushing pattern.

Next, at step S10, the CPU 41 performs image-to-image flushing. The image-to-image flushing is flushing performed in the area between an image on paper and an image P2 following the image P1, as shown in FIG. 7A. In FIG. 7A, F denotes a flushing pattern. In the embodiment, flushing is performed at the timing between images so that the image is not impaired as flushing is performed in the continuous image.

In the embodiment, the image-to-image flushing is performed for the nozzles used for image formation at step S9. As a comparatively small amount of ink is ejected from the nozzles in the area used for image formation, flushing is performed, so that the nozzles can be kept in a good condition for printing with good image quality. To perform flushing, whether or not the nozzles are nozzles in the area used for image formation is determined from the image signal sent for forming an image or stored data in the memory 42 storing image data. As shown in FIG. 6, an image-to-image flushing area R2 is the size of a paper width L2 at the maximum and is smaller than the size of the paper width L2 if an image like a framed photo is printed. In FIG. 6, L3 denotes the width of the transport belt 11.

Next, at step S11, the CPU 41 determines whether or not the value of the counter reaches the nozzle dry limit. If the value does not reach the nozzle dry limit, the CPU 41 goes to step S17 and if the CPU 41 determines at step S17 that print does not end, the CPU 41 returns to step S8. When paper is detected, the CPU 41 repeats printing one image (step S9) and image-to-image flushing (step S10).

If the CPU 41 determines at step S11 that the value reaches the nozzle dry limit, the CPU 41 goes to step S12. At step S12, the CPU 41 waits until the flushing area detection sensor 17 detects the flushing area 21. When a flushing area detection signal indicating that the flushing area 21 is detected is output from the flushing area detection sensor 17, at step S13, the CPU 41 causes the counter to start counting for the flushing timing from the beginning. Next, at step S14, the CPU 41 determines whether or not the value of the counter is the predetermined flushing timing value for each ink head as described above. If the flushing timing is reached for any of the ink heads, at step S15, the CPU 41 performs simultaneous flushing for ejecting ink from all nozzles of the ink head. Here, the volume of an ink droplet ejected in the simultaneous flushing is 10 to 1000 times the volume of an ink droplet ejected in the above-described image-to-image flushing. The purpose of ejecting a larger amount of ink than that in the image-to-image flushing is to make it easy to eliminate the ink increased in viscosity to the dry limit.

Figure 7B:
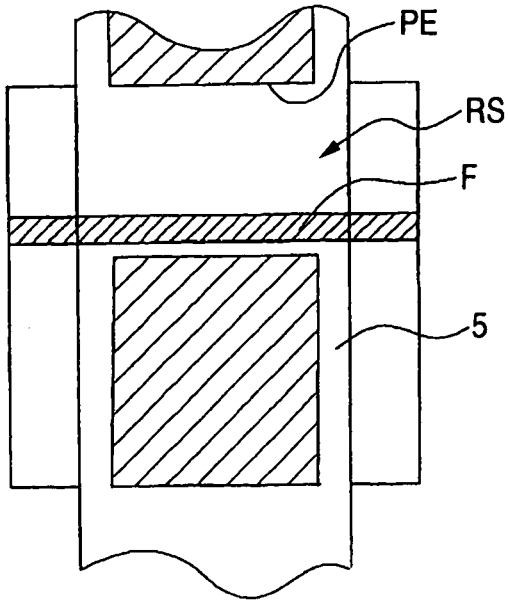

If the time to the flushing timing after image formation is prolonged, an area RS in which nothing is printed waiting for print is formed in the area from an image end PE to the flushing pattern F on the paper 5, as shown in FIG. 7B. To prevent the area RS from occurring, the cutter 16 maybe operated between steps S11 and S12. That is, the cutter 16 is operated at the image rear end PE for separating the paper 5 with an image formed thereon from the roll paper 5 and the paper 5 is ejected to the ejection section 9. After the cutter 16 is operated, the transport belt 11 and the feed roller 6 are rotated backward for collecting unused paper 5 into the side of the roller paper 4. Simultaneous flushing is performed in the flushing area with the paper 5 removed from the top of the transfer belt 11.

Next, at step S16, the CPU 41 determines whether or not simultaneous flushing is complete for all ink heads requiring simultaneous flushing. If not complete, the CPU 41 returns to step S14. On the other hand, if the CPU 41 determines at step S16 that simultaneous flushing is complete for all ink heads requiring simultaneous flushing, at step S17, the CPU 41 determines whether or not the print ends based on a print signal. If the print does not end, the CPU 41 returns to the process at step S8 and the later. Here, if the cutter 16 is operated between steps S11 and S12 to eliminate the area RS, the CPU 41 may return to step S8 after rotating the feed motor 6 for again performing paper feed.

On the other hand, if the print ends, at step S18, the CPU 41 stops rotating the transport motor 13 for stopping the transport belt 11. Next, at step S19, the CPU 41 waits until the paper 5 is cut. When the paper 5 is cut as the cutter 16 provided in the paper ejection section 9 is operated, at step S20, the CPU 41 rotates the transport motor 13 and the feed motor 6 in the reverse direction to that at the printing time for rewinding the paper 5 until the paper 5 is placed out of the nip roller 12, and ends the print. Slack may occur in the paper 5 because of the rewinding. This slack can be removed by turning a handle 4*a* attached to the roll paper 4.

When the print ends, the print head section 8 is capped and is hermetically sealed by the capping mechanism disposed in the maintenance section 20 to prevent ink in the print head section 8 from drying.

According to the embodiment, as the image-to-image flushing is performed, the state of the nozzles used for image formation can be kept optimum and the quality of the formed image can be improved.

The elapsed time since the simultaneous flushing was performed is counted, and simultaneous flushing is again performed before the ink dry limit is exceeded, so that drying the nozzles and making print impossible can be prevented. Since forcible ink exclusion such as purge is not required, image formation can be conducted smoothly.

Further, the simultaneous flushing is performed in the recess on the transport belt, so that ink is not deposited on any other transport belt portion or transport mechanism and dirt of the transport mechanism can be minimized.

The ink recovery ejection timing is separated into the image-to-image flushing and the simultaneous flushing and the simultaneous flushing can be performed only the necessary minimum number of times, so that wasteful ejection of ink can be prevented.

In the embodiment, the nozzle dry limit is defined and flushing is performed for all nozzles before the nozzle dry limit is reached: however, when as many images as the specified number of images have been printed, flushing may be performed for all nozzles.

Next, the operation of a modification example will be discussed based on FIG. 8.

Figure 8:
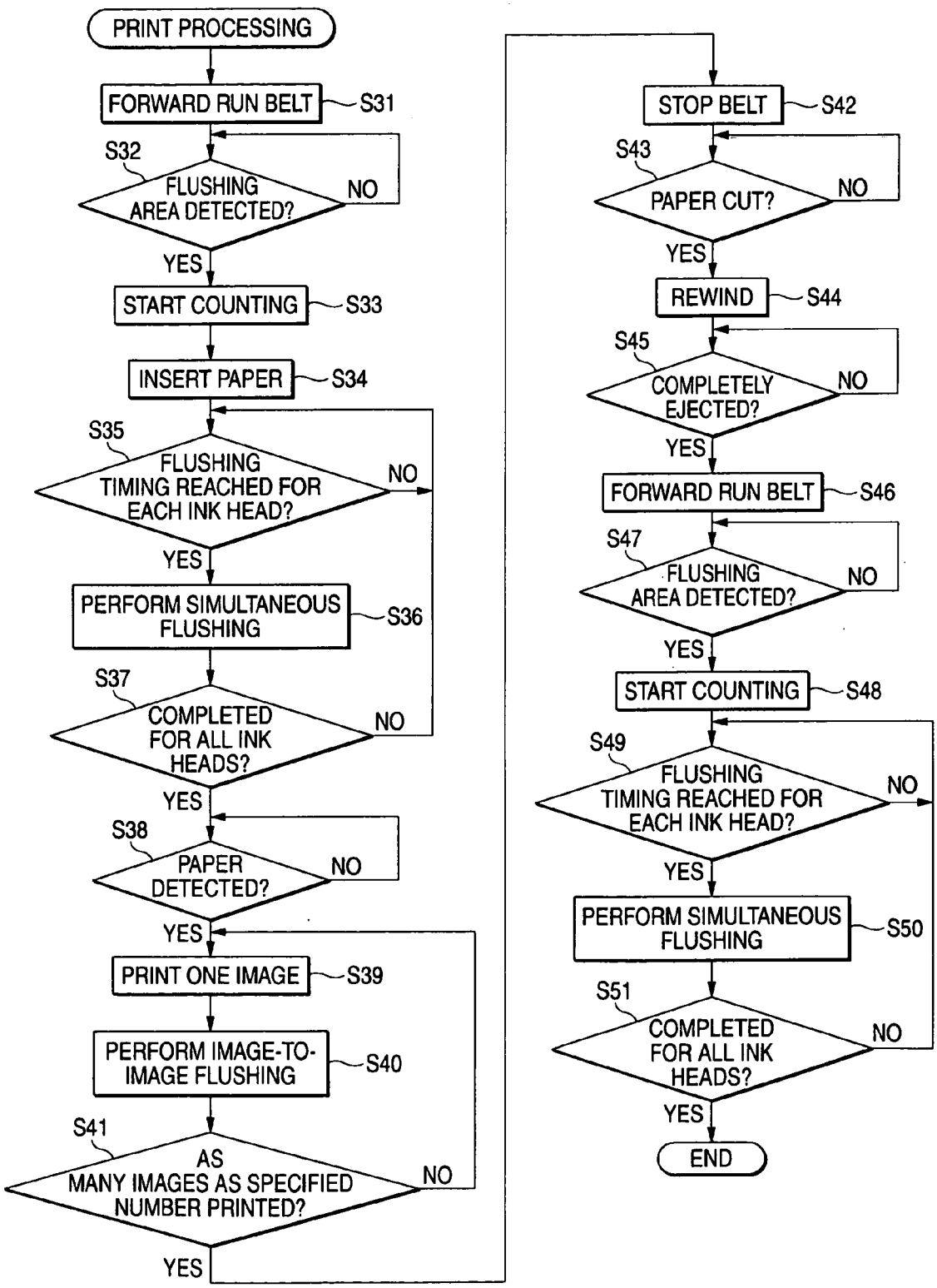
FIG. 8 is a flowchart to describe the operation of an ink jet printer of a modification example.

The operation shown in FIG. 8 is started as the CPU 41 receives a print signal. To begin with, at step S31, the CPU 41 rotates the transport motor 13 for forward running the transport belt 11.

At step S32, the CPU 41 waits until the flushing area detection sensor 17 detects the flushing area 21. When a flushing area detection signal indicating that the flushing area 21 is detected is output from the flushing area detection sensor 17, at step S33, the CPU 41 causes a counter to start counting for the timings of flushing and paper insertion.

Next, at step S34, the CPU 41 drives the feed motor 62 for inserting the paper 5 into the transport mechanism 7.

Next, at step S35, the CPU 41 determines whether or not the value of the counter is a predetermined flushing timing value for each ink head. If the flushing timing is reached for any of the ink heads, at step S36, the CPU 41 performs simultaneous flushing for ejecting ink from all nozzles of the ink head.

Next, at step S37, the CPU 41 determines whether or not simultaneous flushing is complete for all ink heads requiring simultaneous flushing. If not complete, the CPU 41 returns to step S35. On the other hand, if the CPU 41 determines at step S37 that simultaneous flushing is complete for all ink heads requiring simultaneous flushing, at step S38, the CPU 41 waits until the paper detection sensor 18 detects the paper 5. The simultaneous flushing may be performed regardless of the presence or absence of the paper 5; if the simultaneous flushing is performed when the paper 5 exists, the simultaneous flushing may be performed after the paper 5 is detected. In this case, step S38 (paper detection determination step) may be executed preceding step S35.

If the paper 5 is detected at step S38, at step S39, the CPU 41 prints an image by the print heads 8K, 8Y, 8M, and 8C.

If it is possible to print without degradation of the image quality without image-to-image flushing, two or more images may be printed continuously.

Next, at step S40, the CPU 41 performs image-to-image flushing. Also in the modification example, the image-to-image flushing is performed for the nozzles used for image formation at step S39.

Next, at step S41, the CPU 41 determines whether or not as many images as the specified number of images have been printed. If the number of the printed image does not reach the specified number of images, the CPU 41 returns to step S39 and prints one image (step S39) and performs image-to-image flushing (step S40).

If the CPU 41 determines at step S41 that the number of the printed image reaches the specified number of images, the CPU 41 goes to step S42. At step S42, the CPU 41 stops rotating the transport motor 13 for stopping the transport belt 11. Next, at step S43, the CPU 41 waits until the paper 5 is cut. When the paper 5 is cut as the cutter 16 provided in the paper ejection section 9 is operated, at step S44, the CPU 41 rotates the transport motor 13 and the feed motor 6 in the reverse direction to that at the printing time for rewinding the paper 5 to the roll paper 4. Next, at step S45, the CPU 41 waits until the paper 5 is completely ejected from the printer main unit 2. If the paper 4 is completely ejected, at step S46, the CPU 41 forward runs the belt. Next, the CPU 41 waits until the flushing area detection sensor 17 detects the flushing area 21. When a flushing area detection signal indicating that the flushing area 21 is detected is output from the flushing area detection sensor 17, at step S48, the CPU 41 causes the counter to start counting for the flushing timing from the beginning. Next, at step S49, the CPU 41 determines whether or not the value of the counter is the predetermined flushing timing value for each ink head as described above. If the flushing timing is reached for any of the ink heads, at step S50, the CPU 41 performs simultaneous flushing for ejecting ink from all nozzles of the ink head. Next, at step S51, the CPU 41 determines whether or not simultaneous flushing is complete for all ink heads requiring simultaneous flushing. If not complete, the CPU 41 returns to step S49. On the other hand, if the CPU 41 determines at step S51 that simultaneous flushing is complete for all ink heads requiring simultaneous flushing, the CPU 41 ends the print.

Also in the modification, the size of an ink droplet ejected in the simultaneous flushing is larger than the size of an ink droplet ejected in the image-to-image flushing.

Also in the modification, similar advantages to those in the embodiment described above can be provided.

The embodiment and its modification example have been described. The invention can also be applied to an apparatus including a transport system having no transport belt. For example, image-to-image flushing is also possible in a printer of the type wherein paper 5 is sandwiched between two transport rollers and two nip rollers provided facing the transport rollers and print is executed while the paper 5 is transported between the two transport rollers. For the simultaneous flushing, a shutter may be provided in a platen portion facing the print head section 8 and when the shutter is open, the simultaneous flushing may be performed.

Although the simultaneous flushing is performed for all nozzles in the embodiment, the flushing may be performed only for the nozzles not used in image formation. When flushing is performed, whether the nozzle is a nozzle not used for image formation can be determined from the image signal sent for forming an image or stored data in the memory 42 storing image data. Thus, when the width of the paper (print area) is smaller than the width of the printable range of the print head, the nozzles at positions beyond the width of the print area are not used; simultaneous flushing is performed or flushing is performed only for the nozzles not used, whereby the print head can be recovered without purging the ejection capability for all nozzles.

The image-to-image flushing may be performed with respect to nozzles disposed within the print area. For example, the nozzles that are not frequently used can be determined from the image signal sent for forming an image or stored data in the memory 42 storing image data. The image-to-image flushing for ejecting ink may be performed with respect to such nozzles that are determined to be less frequently used. Such ejection of ink with respect to the less-frequently-used nozzles may be performed along with the ink ejection with respect to the nozzles that are disposed out of the print area.

The image-to-image flushing at steps S10 and S40 corresponds to processing of the first recovery ejection means, and the simultaneous flushing at steps S6, S15, S36, and S50 corresponds to processing of the second recovery ejection means.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments maybe made without departing from the spirit and scope of the invention.

What is claimed is:

1. An image formation apparatus comprising:

a transport unit that transports a record medium;

a print head having a plurality of nozzles that eject ink, thereby forming an image on the record medium;

a first recovery ejection unit that performs recovery ejection of nozzles used for forming an image on the record medium;

a second recovery ejection unit that performs recovery ejection of at least one of the plurality of nozzles in accordance with a time elapsed from a previous recovery ejection; and a cleaning unit, wherein the transport unit includes a transport belt that transports the record medium;

the second recovery ejection unit performs recovery ejection of nozzles at a predetermined position on the transport belt;

the transport belt has a recess that receives ink ejected to the belt at the predetermined position; and the cleaning unit cleans ink ejected by the second recovery ejection unit.

2. The image formation apparatus as claimed in claim 1, wherein the second recovery ejection unit performs the recovery ejection in a larger ejection amount than the ejection amount of the first recovery ejection unit.

3. The image formation apparatus as claimed in claim 1, further comprising: a time count unit that counts a predetermined time;

wherein the second recovery ejection unit performs the recovery ejection each time the predetermined time counted by the time count unit has elapsed.

4. The image formation apparatus as claimed in claim 1, further comprising: a temperature detection unit that detects an ambient temperature;

wherein the second recovery ejection unit changes the time in response to the temperature detected by the temperature detection unit.

5. The image formation apparatus as claimed in claim 1, further comprising: a humidity detection unit that detects an ambient humidity;

wherein the second recovery ejection unit changes the time in response to the humidity detected by the humidity detection unit.

6. The image formation apparatus as claimed in claim 1, further comprising:

a temperature detection unit that detects an ambient temperature;

wherein the second recovery ejection unit changes ejection amount of ink in response to the temperature detected by the temperature detection unit.

7. The image formation apparatus as claimed in claim 1, further comprising:

a humidity detection unit that detects an ambient humidity;

wherein the second recovery ejection unit changes ejection amount of ink in response to the humidity detected by the humidity detection unit.

8. A recovery ejection method in an image formation apparatus including a transport unit for transporting a record medium and a print head having a plurality of nozzles for ejecting ink for forming an image, the method comprising:

performing a first recovery ejection of nozzles used for forming an image on the record medium;

performing a second recovery ejection of at least one of the plurality of nozzles in accordance with a time elapsed from a previous recovery ejection, wherein the step of performing second recovery ejection includes performing recovery ejection of nozzles at a predetermined position in a recess of a transport belt included in the transport unit, the recess receiving ink ejected in the second recovery ejection; and cleaning the ink ejected in the second recovery ejection.

9. The recovery ejection method claimed in claim 8, wherein the step of performing second recovery ejection includes performing recovery ejection in a larger ejection amount than the ejection amount of the first recovery ejection.

10. The recovery ejection method as claimed in claim 8, wherein the step of second recovery ejection includes ejecting ink each time a predetermined time has elapsed.

11. The recovery ejection method as claimed in claim 8, wherein the step of second recovery ejection includes changing the time in response to an ambient temperature.

12. The recovery ejection method as claimed in claim 8, wherein the step of second recovery ejection includes changing the time in response to an ambient humidity.

13. The recovery ejection method as claimed claim 8, wherein the step of second recovery ejection includes changing ejection amount of ink in response to an ambient temperature.

14. The recovery ejection method as claimed claim 8, wherein the step of second recovery ejection includes changing ejection amount of ink in response to an ambient humidity.

15. An image formation apparatus comprising:

a transport belt that transports a record medium in a transporting direction and includes a surface having a recess extending in a predetermined direction that crosses the transporting direction;

a print head having a plurality of nozzles that ejects ink on the record medium;

a maintenance unit movable between a first position and a second position, the maintenance unit positioned at the first position while the nozzle is not ejecting the ink and at the second position while the nozzle is ejecting the ink, the first position being between the print head and the transport belt, the second position positioning in the predetermined direction with respect to the first position; and a controller configured to control driving of the transport belt and the print head and to perform a recovery ejection operation of the nozzles of the print head;

wherein the controller controls the transport belt and the print head so that the ink is ejected onto the recess while performing the recovery ejection operation; and the maintenance unit includes a cleaning portion that cleans the recess when the maintenance unit moves between the first position and the second position.

16. The image formation apparatus as claimed in claim 15, wherein the cleaning portion is disposed in the recess when the maintenance unit is positioned in the first position; and the cleaning portion moves within the recess in the predetermined direction when the maintenance unit moves between the first position and the second position.

17. The image formation apparatus as claimed in claim 15, wherein the recess extends to a side edge of the transfer belt.

18. The image formation apparatus as claimed in claim 15, wherein the cleaning portion is disposed at a position that faces to the transport belt when the maintenance unit is at the first position.

19. The image formation apparatus as claimed in claim 15, wherein the cleaning portion includes a wiper that wipes the recess.

* * * * *